US006338700B1

(12) United States Patent
Pollock

(10) Patent No.: US 6,338,700 B1
(45) Date of Patent: Jan. 15, 2002

(54) ADJUSTABLE LEG STRETCHER

(76) Inventor: Todd E. Pollock, 4800 W. Lucy Lake Dr., HC31/5263 GP, Wasilla, AK (US) 99654

( * ) Notice: Subject to any disclaimer, the term of this patent is extended or adjusted under 35 U.S.C. 154(b) by 0 days.

(21) Appl. No.: 09/559,618

(22) Filed: Apr. 27, 2000

Related U.S. Application Data

(60) Provisional application No. 60/131,325, filed on Apr. 27, 1999.

(51) Int. Cl.[7] ..... A63B 21/12
(52) U.S. Cl. ..... 482/95; 482/904; 482/907
(58) Field of Search ..... 482/95, 126, 121, 482/91, 80, 82, 904, 97, 102, 907

(56) References Cited

U.S. PATENT DOCUMENTS 4,375,886 A * 3/1983 Muys ..... 482/81
5,067,709 A * 11/1991 Christianson ..... 482/907
5,405,306 A * 4/1995 Goldsmith et al. ..... 482/120
5,595,559 A * 1/1997 Viel ..... 482/91
5,634,873 A * 6/1997 Carlstrom ..... 482/95
6,110,083 A * 8/2000 Riser ..... 482/907
6,113,564 A * 9/2000 McGuire ..... 602/32

* cited by examiner

*Primary Examiner*—Jerome Donnelly
(74) *Attorney, Agent, or Firm*—Richard C. Conover

(57) ABSTRACT

A leg stretcher used to stretch a user's hamstring muscles when the user is lying in a supine position. The leg stretcher including a conventional pulley suspended from any convenient support at a position above the user's head. A rope is threaded through the pulley, and at one end thereof has an adjustable stirrup to be placed around the user's ankle. The stirrup is adjustable in size to accommodate a particular user's ankle. The opposite end of the rope is then threaded through a cord lock and a handle bar with the cord lock fixedly attached to the handle bar. This end of the rope is then secured to an adjustment handle which is used to adjust the length of the rope and also prevents the rope from slipping through the handle bar.

9 Claims, 3 Drawing Sheets

ADJUSTABLE LEG STRETCHER

This application claims benefit of provisional application 60/131,325, filed Apr. 27, 1999.

BACKGROUND OF INVENTION

Leg stretching devices are well known. See for example, U.S. Pat. No. 3,117,782 to Johnston; U.S. Pat. No. 5,067,709 to Christianson; U.S. Pat. No. 5,261,865 to Trainor; U.S. Pat. No. 5,405,306 to Goldsmith, et al.; and U.S. Pat. No. 5,634,873 to Carlstrom. All of these patents show devices for stretching and strengthening muscles of the lower back and legs of a person in a supine position. All of these patents show a rope and pulley system operated by a person by pulling and releasing a rope which extends to a support above the head and then to a person's foot. The rope is pulled by a user to raise and stretch a leg or legs. None of these patents show a device where the rope is easily adjustable in length to accommodate a user of a different height and to optimize mechanical advantage desirable for stretching.

SUMMARY OF INVENTION

The present invention relates to a leg stretcher used to stretch a user's hamstring muscles when the user is lying in a supine position. A conventional pulley is suspended from any convenient support at a position above the user's head. A rope is threaded through the pulley, and at one end thereof has an adjustable stirrup to be placed around the user's ankle. The stirrup is adjustable in size to accommodate a particular user's ankle. The opposite end of the rope is then threaded through a cord lock and a handle bar with the cord lock fixedly attached to the handle bar. This end of the rope is then secured to an adjustment handle which is used to adjust the length of the rope and prevent the rope from slipping through the handle bar.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
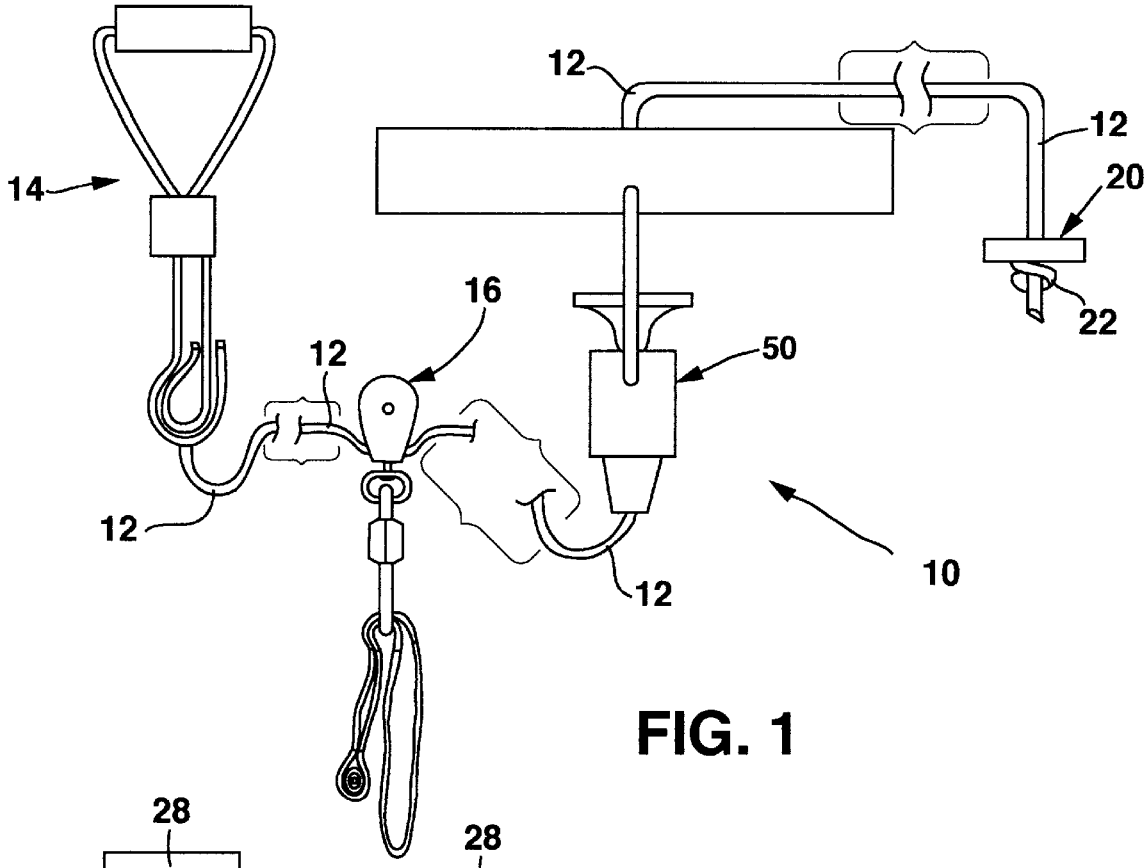
FIG. 1 is an elevational view of all the components of the adjustable leg stretcher strung together on one rope.

An elevational view of an adjustable leg stretcher 10 is shown in FIG. 1 with all the components strung together on a single rope 12.

Figure 2:
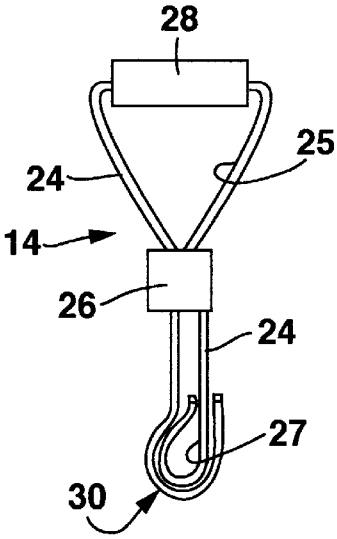
FIG. 2 is an elevational view of a stirrup shown in FIG. 1.
Figure 3:
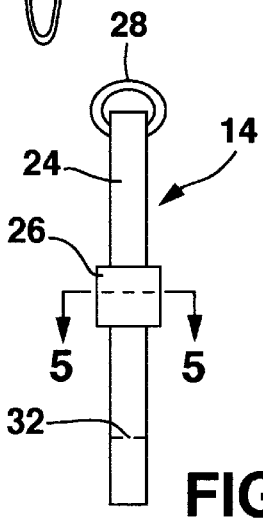
FIG. 3 is a right side view of the stirrup shown in FIG. 2.
Figure 5:
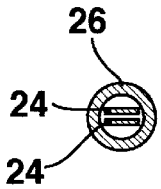
FIG. 5 is a cross-sectional view taken along the line 5—5 in FIG. 3 with background parts broken away for clarity.
Figure 4:
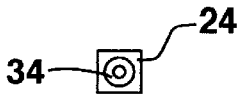
FIG. 4 is a bottom view of the stirrup shown in FIG. 3 with background parts broken away for clarity.

One end of rope 12 is connected to an adjustable size stirrup 14 as shown in FIG. 1. As shown in FIG. 2, stirrup 14 includes a strap 24 which has been folded to form a first loop 25 and a second loop 27 with the free ends of strap 24 stitched together at 32 to form a reinforced end 30 as shown in FIG. 3. A grommet 34 is provided in second loop 27 as shown in FIG. 4. The rope 12 is threaded through grommet 34 and a free end knotted in loop 27 to secure stirrup 14 to rope 12 as shown in FIG. 1.

A foot support 28 is positioned on strap 24 within loop 25 as shown in FIG. 2. In a preferred embodiment, foot support 28 is constructed of a flexible tube slidably positioned in surrounding relation with strap 24.

An adjustment sleeve 26 is positioned in surrounding relation with folded strap 24 as shown in FIG. 2, and is provided to adjust the size of loop 25 to accommodate a user's ankle.

Figure 7:
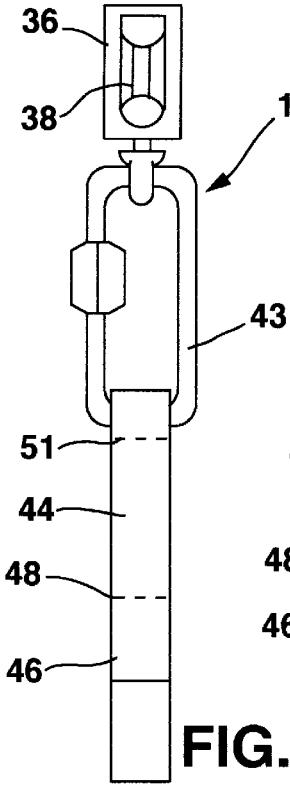
FIG. 7 is a right side view of the pulley with strap shown in FIG. 6.
Figure 6:
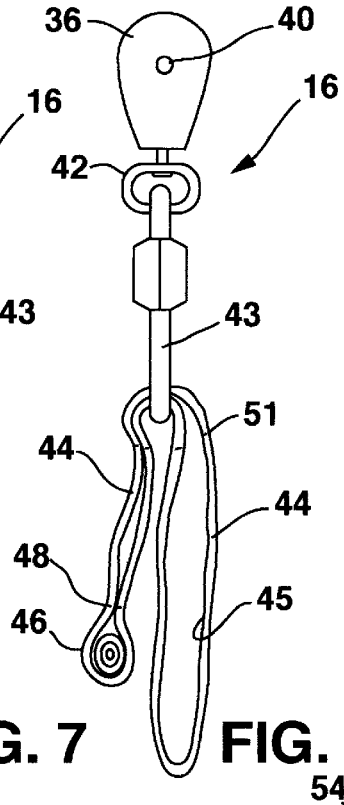
FIG. 6 is an elevational view of a pulley with strap shown in FIG. 1.
Figure 14:
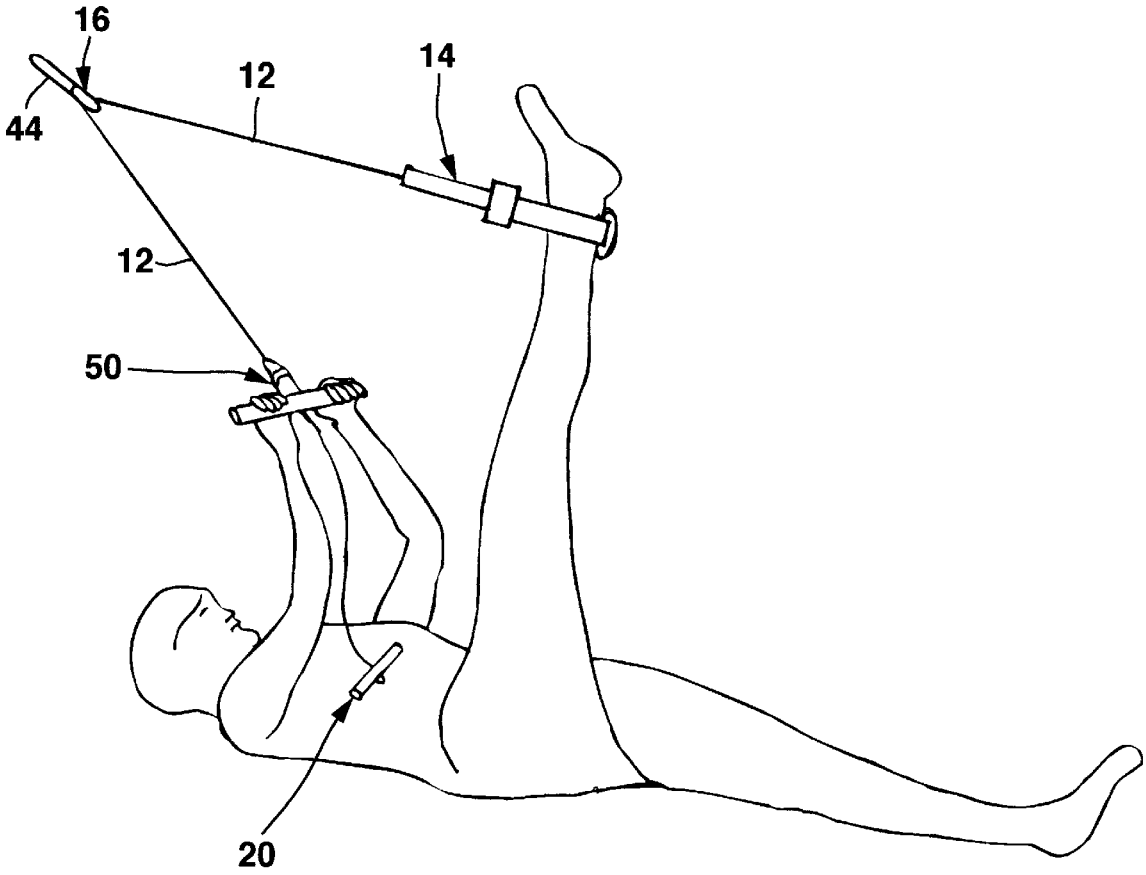
FIG. 14 is a perspective view of the adjustable leg stretcher according to the present invention with the stirrup placed around a user's ankle.

Rope 12 is then led through pulley 16 as shown in FIG. 1. As best seen in FIGS. 6 and 7, pulley 16 is a conventional pulley with a housing 36, wheel 38 rotating on shaft 40, and a swivel ring 42. A conventional threaded locking link 43 is positioned to extend through swivel ring 42. A strap 44 is folded on itself to form a loop 45 and free ends of strap 44 sewn together at 48 to form a reinforced end 46 as shown in FIGS. 6 and 7. Folded strap 44 is threaded through threaded locking link 43 and secured thereto with stitches 51. With this apparatus, the pulley 16 may be supported above a user lying in a supine position as shown in FIG. 14 at least three different ways. First, the reinforced end 46 may be slipped between a door and a corresponding door jamb at the hinge side of the door to support the pulley; second, the threaded locking link 43 may be opened and threaded through an eye bolt to support the hinge; and third, the loop 45 may be looped or around a structure, such as a fence post, to support the pulley, or may be formed into a slip knot for securing the pulley to the support structure.

Figure 11:
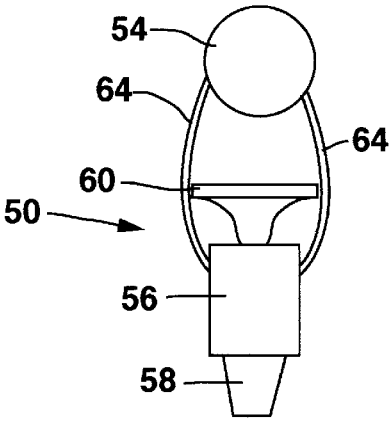
FIG. 11 is a right side view of the handgrip shown in FIG. 8.
Figure 8:
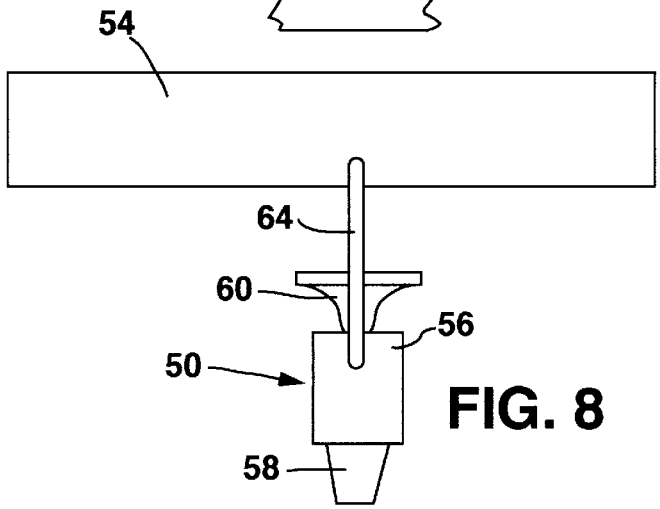
FIG. 8 is an elevational view of a handgrip shown in FIG. 1.
Figure 10:
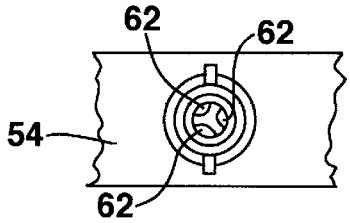
FIG. 10 is a bottom view of the handgrip shown in FIG. 8 with parts broken away.
Figure 15:
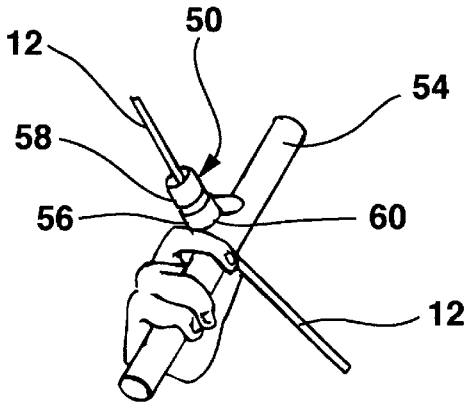
FIG. 15 is a perspective view of a cord lock used with the present invention being operated with a finger of a user.

As shown in FIG. 1, rope 12 is then led through a releasable cord lock 50, which in a preferred embodiment is a clothesline tightener number F12-70 manufactured by Franklin Cord lock 50 according to the present invention permits a rope to be drawn through the cord lock in one direction, but locks the rope so that the rope cannot move in the opposite direction without release of the cord lock. As shown in FIGS. 8, 10 and 11, cord lock 50 has a body 56 with a tapered portion 58 that tapers away from the body as best seen in FIG. 8. At the end of body 58 opposite tapered portion 58, a release grip 60 is spring-loaded to the closed, gripping position. Internally, tapered portion 58 has three equally spaced ball bearings 62 surrounding a central opening as shown in FIG. 10. Rope 12 is positioned to run through this central opening in cord lock 50. As release grip 60 is moved away from body 56 against the pressure of an internal spring, ball bearings 62 release their grip on a rope passing between them. As release grip 60 moves closer to body 56 under the action of the internal spring, ball bearings 62 are forced into rope 12 to hold it tightly. The release grip 60 is formed with a lip which can be easily manipulated with fingers of a user as shown in FIG. 15. It should be understood that other types of cord locks could be used equally as well.

A pair of support rods 64 hold cord lock 50 in a spaced apart position relative to a handle bar 54. Both rods 64 at adjacent ends are fixedly attached as by welding to cord lock 50. At the opposite ends of rods 64, both are fixedly attached to handle bar 54.

Figure 9:
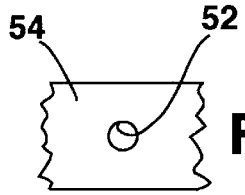
FIG. 9 is a top plan view of the handgrip shown in FIG. 8 with parts broken away.

As best seen in FIG. 9, handle bar 54 has a bore 52 sized to receive rope 12. Bar 54 is also positioned so that bore 52 is in line with body 56 before rods 64 are welded in place. Rope 12 is then positioned to pass through both cord lock 50 and bar 54 without a significant bend in the rope.

Figures 12, 13:
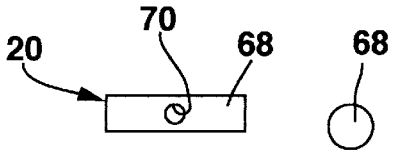
FIG. 12 is a top plan view of an adjustment handle shown in FIG. 1.
FIG. 13 is a right side view of the adjustment handle shown in FIG. 12.

As shown in FIG. 1, rope 12 is then led from handle bar 54 to adjustment handle 20. As shown in FIG. 12, adjustment handle 20 has a bore 70 passing through the adjustment handle. Rope 12 is led through bore 70 and then a knot 22, as shown in FIG. 1, is tied in the rope to hold adjustment handle 20 adjacent this end of the rope.

In operation, a user hangs pulley 16 with reinforced end 46, threaded locking link 43 or strap 44 on some appropriate support above a user's head when lying in a supine position. Stirrup 14 is placed over the user's ankle as shown in FIGS. 14 and 15 and the size of the stirrup is adjusted using adjustment sleeve 26. The user then grips bar 54 in one hand, and adjustment handle 20 in the other hand. The adjustment handle 20 is drawn in a direction away from bar 54 to draw the rope through cord lock 50. If the rope needs to be moved in the other direction. The user's fingers on bar 54 can then easily slide under release grip 60 on cord lock 50 so that the cord lock's grip on rope 12 can be released against spring pressure. Cord lock 50 is then adjusted forward or back along rope 12 to a comfortable position as shown in FIGS. 14 and 15. Then release grip 60 is released so that cord lock 50, under spring pressure, clamps rope 12 in the desired position. This movement of bar 54 positions the bar in the desired position.

Once these two adjustments are made, the user can begin exercising his/her hamstring muscles by pulling bar 54 as best seen in FIG. 14. The present invention 10 is then used for static stretching of the hamstring muscles.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

I claim:

1. A leg stretching device for use with a user lying in a supine position comprising:

an adjustable size stirrup for positioning on a user's ankle;

a rope having one end fixedly secured to the adjustable stirrup;

a pulley affixed to a support vertically above a user's head;

the rope extending through the pulley;

a handle bar having a hole extending through the handle bar;

an adjustable cord lock fixedly secured to the handle bar adjacent the hole in the handle bar;

the adjustable cord lock having means for gripping the rope at a selected position and allowing for free movement of the rope through the cord lock in one direction and further including means for releasably gripping the rope to prevent the rope from moving through the cord lock in the opposite direction;

the rope extending through the cord lock and the corresponding hole in the handle bar;

a stop means secured to a free end of the rope for preventing the rope from slipping through the handle bar.

2. The stretching device according to claim 1 wherein the adjustable cord lock includes a lip manipulable by a finger of the user to release the rope from the gripping means.

3. The stretching device according to claim 1 wherein the pulley is connected to a strap loop and the strap loop is hung from the support above a user's head to support the pulley above the user's head.

4. The stretching device according to claim 1 wherein the pulley is connected to a threaded locking link ring and the threaded locking a link ring is hung from the support above a user's head to support the pulley above the user's head.

5. The stretching device according to claim 1 wherein the pulley is connected to a strap having a reinforced end and the reinforced end is used to hang the pulley from the support above a user's head.

6. The stretching device according to claim 1 wherein the adjustable stirrup includes a strap folded to form a loop for positioning on a user's ankle and further includes a means for adjusting the size of the loop.

7. The stretching device according to claim 6 wherein the means for adjusting the size of the loop comprises a sleeve slidably positioned in surrounding relation to the folded strap.

8. A leg stretching device for use with a user lying in a supine position comprising:

an adjustable sized stirrup for positioning on a user's ankle;

a rope having one end fixedly secured to the adjustable stirrup;

a pulley affixed to a support vertically above a user's head;

the rope extending through the pulley;

a handle bar; and an adjustable cord lock fixedly secured to the handle bar;

the rope extending through the cord lock;

the adjustable cord lock having means for gripping the rope at a selected position and for allowing free movement of the cord through the cord lock freely in one direction releasably gripping the rope to prevent further movement of the rope through the cord lock in the opposite direction.

9. The leg stretching device according to claim 8 further including a stop means secured to a free end of the rope for preventing the rope from slipping through the cord lock.

* * * * *